US011701669B2

(12) United States Patent
Ketterer

(10) Patent No.: US 11,701,669 B2
(45) **Date of Patent: *Jul. 18, 2023**

(54) OUTLET NOZZLE FOR A CENTRIFUGAL DRUM, CENTRIFUGAL DRUM AND ASSEMBLY TOOL

(71) Applicant: GEA MECHANICAL EQUIPMENT GMBH, Oelde (DE)

(72) Inventor: Kristin Katja Ketterer, Oelde (DE)

(73) Assignee: GEA MECHANICAL EQUIPMENT GMBH, Oelde (DE)

( * ) Notice: Subject to any disclaimer, the term of this patent is extended or adjusted under 35 U.S.C. 154(b) by 185 days.

This patent is subject to a terminal disclaimer.

(21) Appl. No.: 17/166,511

(22) Filed: Feb. 3, 2021

(65) Prior Publication Data

US 2021/0178407 A1 Jun. 17, 2021

Related U.S. Application Data

(63) Continuation of application No. 16/096,072, filed as application No. PCT/EP2017/057947 on Apr. 4, 2017, now Pat. No. 11,020,754.

(30) Foreign Application Priority Data

Apr. 29, 2016 (DE) ..... 10 2016 108 057.8

(51) Int. Cl.
*B05B 1/02* (2006.01)
*B04B 1/12* (2006.01)
(Continued)

(52) U.S. Cl.
CPC ..... *B05B 1/02* (2013.01); *B04B 1/10* (2013.01); *B04B 1/12* (2013.01); *B04B 1/08* (2013.01); *B04B 11/02* (2013.01)

(58) Field of Classification Search
CPC .... B05B 1/02; B04B 1/12; B04B 1/08; B04B 11/02; B04B 1/10; B04B 1/14; B04B 1/16; B04B 1/18
See application file for complete search history.

(56) References Cited

U.S. PATENT DOCUMENTS 2,060,239 A * 11/1936 Peltzer ..... B04B 1/12 494/43
2,068,520 A * 1/1937 Strezynski ..... B04B 1/12 494/38
(Continued)

FOREIGN PATENT DOCUMENTS

CA 2305409 A1 4/1999
CA 2579251 A1 3/2006
(Continued)

OTHER PUBLICATIONS

International Search Report dated Sep. 14, 2017 in related International Application No. PCT/EP2017/057947.
(Continued)

*Primary Examiner* — Charles Cooley
(74) *Attorney, Agent, or Firm* — Patent Portfolio Builders PLLC

(57) ABSTRACT

An outlet nozzle for centrifugal drums has a nozzle body with at least one cylindrical portion and having an insert connected to the nozzle body. An inlet channel and an outlet channel, which is oriented at an angle with respect to the inlet channel, are formed in the nozzle body. The insert has a torque transmitting contour for arranging a tool with a complementary tool torque transmitting contour in position in order to rotatingly secure the nozzle body in an opening of a rotatable centrifugal drum and to release said nozzle body. The insert also has a polygonal cross-section, which is smaller than the cross-section of the cylindrical section. The insert starting from the polygonal, in particular, rectangular
(Continued)

Figure 1A:
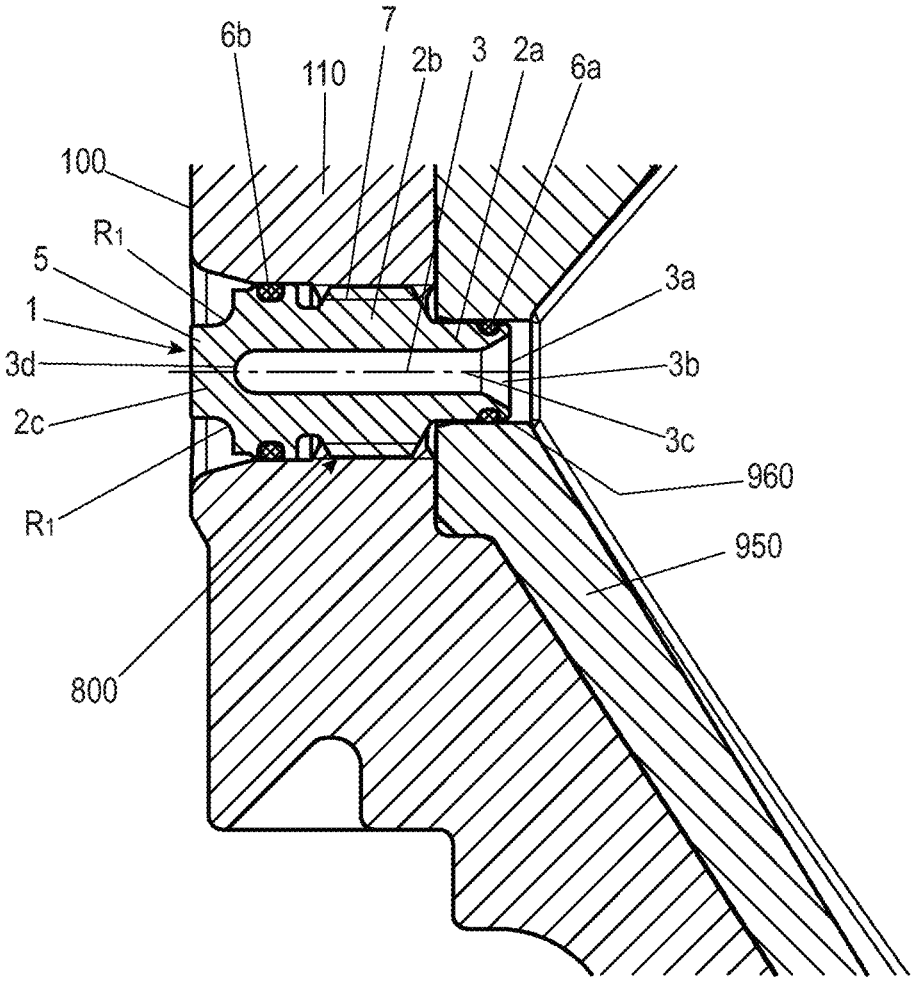

cross-section, merges with the cylindrical section of the nozzle body over rounded surfaces having a radius greater than 1.0 mm.

9 Claims, 3 Drawing Sheets

(51) Int. Cl.
*B04B 1/10* (2006.01)
*B04B 1/08* (2006.01)
*B04B 11/02* (2006.01)

(56) References Cited

U.S. PATENT DOCUMENTS 2,410,313 A * 10/1946 Strezynski ..... B04B 1/12 494/38
2,560,239 A 7/1951 O'Farrell
2,570,164 A 10/1951 Shaft
2,695,748 A * 11/1954 Millard ..... B04B 1/12 494/38
3,075,696 A * 1/1963 Fitzsimmons ..... B04B 1/12 494/56
3,795,362 A * 3/1974 Caldwell ..... B04B 1/12 494/10
3,902,661 A * 9/1975 Meis ..... B04B 7/12 494/38
5,033,680 A * 7/1991 Schultz ..... B04B 1/12 239/589
5,257,698 A 11/1993 Christ et al.
6,216,959 B1 * 4/2001 Garrison ..... B04B 1/10 239/1
6,511,005 B2 * 1/2003 Bouchillon ..... B04B 1/12 239/223
8,419,607 B2 * 4/2013 Mackel ..... B04B 1/12 494/56
8,672,243 B2 * 3/2014 Turcic ..... B04B 1/14 239/589
10,315,203 B2 * 6/2019 Mackel ..... B04B 1/12
11,020,754 B2 * 6/2021 Ketterer ..... B04B 1/10
2006/0166803 A1 * 7/2006 Schulz ..... B04B 1/12 494/56
2009/0140081 A1 * 6/2009 Turcic ..... B04B 1/12 239/589
2010/0062923 A1 * 3/2010 Mackel ..... B04B 1/12 494/56
2015/0306606 A1 * 10/2015 Mackel ..... B04B 5/12 494/56
2020/0023384 A1 * 1/2020 Ketterer ..... B05B 1/02
2021/0178407 A1 * 6/2021 Ketterer ..... B04B 1/12
2022/0410179 A1 * 12/2022 Kraus ..... B04B 1/10

FOREIGN PATENT DOCUMENTS

DE 3922619 C1 10/1990
DE 4105903 A1 8/1992
DE 19527039 C1 12/1996
DE 102016108057 A1 11/2017
FR 780029 A 4/1935
WO 9920400 A1 4/1999
WO 2006029200 A1 3/2006
WO 2014086735 A2 6/2014
WO 2020035433 A1 2/2020

OTHER PUBLICATIONS

Search Report created on Dec. 19, 2016 in related DE Application No. 10 2016 108 057.8.
Written Opinion dated Sep. 14, 2017 in related International Application No. PCT/EP2017/057947.

* cited by examiner

OUTLET NOZZLE FOR A CENTRIFUGAL DRUM, CENTRIFUGAL DRUM AND ASSEMBLY TOOL

BACKGROUND AND SUMMARY OF THE INVENTION

Exemplary embodiments of the invention relate to an outlet nozzle for a centrifugal drum, to a centrifugal drum having such an outlet nozzle, and to an assembly tool for installing an outlet nozzle in an opening of the centrifugal drum.

Outlet nozzles of the prior art are shown by DE 39 22 619 C1, DE 41 05 903 A1, U.S. Pat. No. 2,560,239 and DE 195 27 039 C1.

According to DE 195 27 039 C1, the diameter of the entry port of the outlet nozzle in the region of the nozzle body is either exactly as large as the diameter of the outlet channel or it is maximally 50 percent larger or 50 percent smaller than the diameter of the outlet channel. In addition, the intake space steadily widens up to a largest diameter. The diameter of the outlet channel in the nozzle block initially tapers up to a constriction and then, in one of the variants of DE 195 27 039 C1, conically widens by an angle of at least 5°.

In order to be able to further reduce the tendency to block the outlet nozzle and to positively influence the exit jet, WO 2014/086 735 A2 discloses that the narrowest point of the outlet channel, in terms of the cross section, is formed by the entry port itself. It is further provided that the cross-section of the outlet channel is at no point reduced over the preferably entire axial length of the outlet channel in the exit direction—apart from a possibly provided production radius at the inlet. In this way, the tendency to block and the formation of the nozzle jet is diminished by easily implementable modification of the design of the outlet channel of the nozzle block.

For the installation and removal of outlet nozzles of this type, tools having a dovetail-shaped groove, which are slidable over, in the installed state, a radially outer dovetailed protrusion of the outlet nozzle, are known. With this tool, the nozzle, which has an external thread or an external bayonet, can be screwed into an internally threaded drum opening and unscrewed from the same. In order to avoid a tendency to accumulate dirt and in order to improve hygienic cleanability, an alternative to this solution comprising a large number of undercuts and gaps should be provided, which alternative requires no dovetail and no difficult-to-clean gaps.

Starting from the known prior art, embodiments of the present invention are directed to an outlet nozzle that is advantageous from a hygienic viewpoint and also from an energy viewpoint, a centrifugal drum having such an outlet nozzle, and, in particular, an assembly tool, which is advantageous from a hygienic viewpoint, for the installation and removal of an outlet nozzle.

According to an embodiment, an outlet nozzle for centrifugal drums, comprises a nozzle body, which has at least one cylindrical portion and a protrusion, wherein in the nozzle body are configured an inlet channel and an outlet channel oriented at an angle thereto, and wherein the protrusion is provided with a torque transmitting contour for the application of a tool having a complementarily configured tool/torque transmitting contour in order to fasten the nozzle body rotatingly in an opening of a rotatable centrifugal drum and release it from the same, wherein the protrusion has a polygonal, in particular a rectangular cross-section, which is smaller than the cross section of the cylindrical portion, and wherein the protrusion, starting from the polygonal, in particular rectangular cross section, merges into the cylindrical portion of the nozzle body via rounded surfaces having a radius exceeding 1.5 mm.

This outlet nozzle is easily installable and removable and has a torque transmitting contour which is barely prone to dirt accumulations or incrustations and can be cleaned in a thoroughly hygienic manner.

For this, it is further expedient and still more advantageous if the protrusion merges into the cylindrical portion of the nozzle body via rounded surfaces having a radius exceeding 2.0 mm.

Fluidically, it is advantageous if the inlet channel and the outlet channel are oriented/configured at an obtuse angle to each other.

In order to prevent a large part of the product phase leaving the openings from splashing against the drum, it is advantageous if an exit end of the outlet channel is configured in the region of the protrusion, wherein it is further preferred that the exit end of the outlet channel is configured in an outer radial region, in particular the outer half, of the protrusion.

The invention further provides in an advantageous manner a centrifugal drum having a drum wall which has a plurality of circumferentially distributed openings for the insertion of outlet nozzles.

The invention further provides a tool for rotatingly installing an outlet nozzle, in particular an outlet nozzle as disclosed herein, into an opening of a drum wall of a centrifugal drum, having a drum wall which has a plurality of circumferentially distributed openings for the insertion of outlet nozzles, wherein the tool has a socket wrench having a torque transmitting contour, and a sleeve which is axially slidable in whole or in part over the socket wrench. For, with this tool, the nozzle is able to be installed and removed particularly easily.

It is further advantageous if the diameter of the sleeve is dimensioned such that the outlet nozzle is insertable in whole or in part into the sleeve, and that the outlet nozzle, in the state inserted in the sleeve, is held clampingly therein. For, in this way, the outlet nozzle is held captively in a simple manner during the installation. This is easily realizable, according to an advantageous variant, if the outlet nozzle, in the state inserted in the sleeve, is held clampingly therein in the region of a sealing ring.

BRIEF DESCRIPTION OF THE DRAWING FIGURES

Figure 1B:
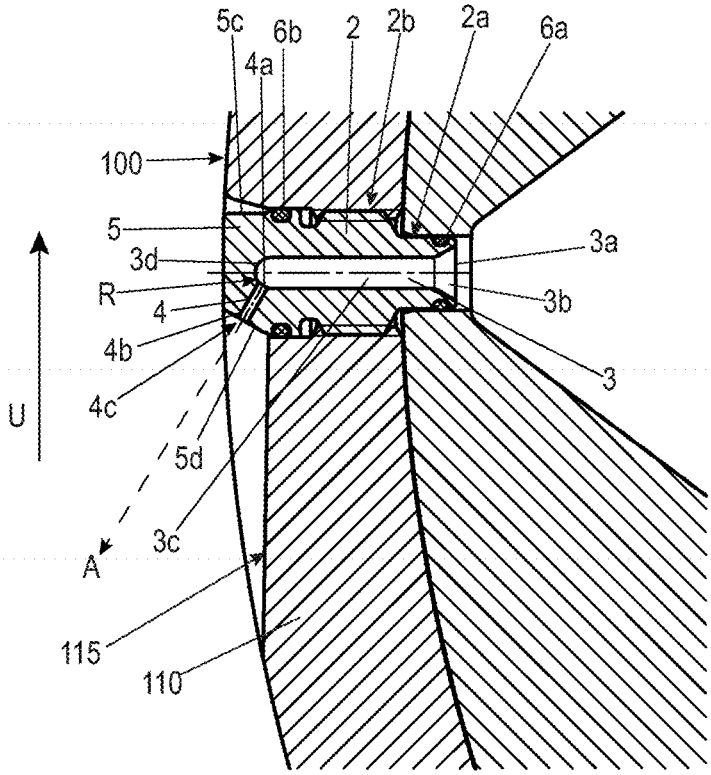
Figure 2:
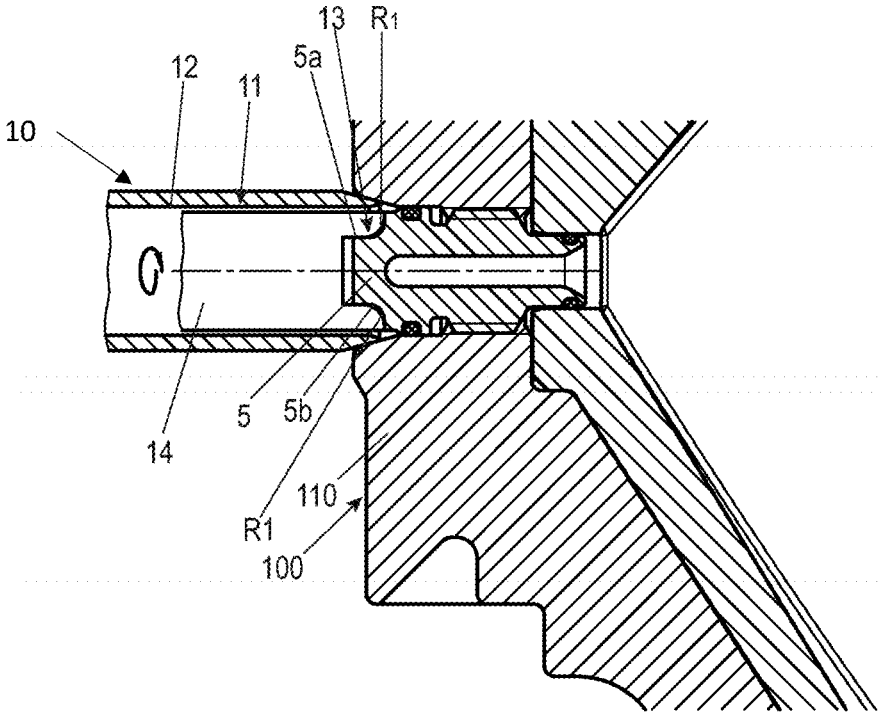
Figure 3:
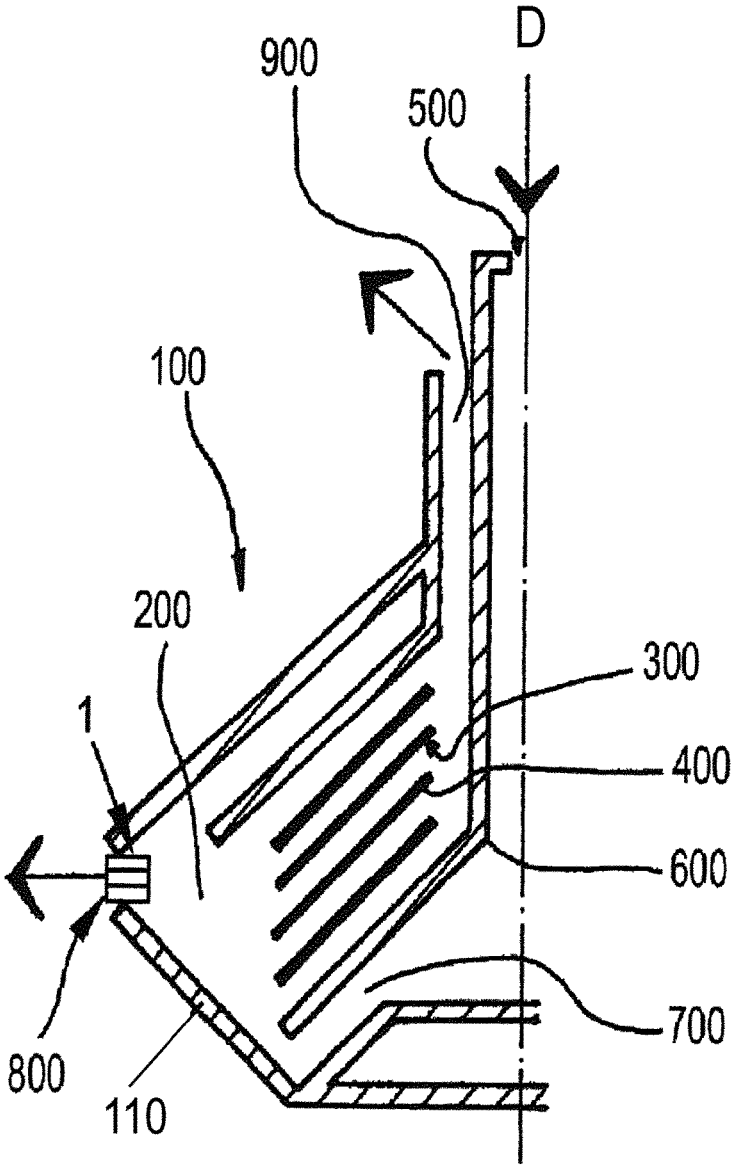

Below, the invention is described in greater detail on the basis of an illustrative embodiment with reference to the figures, wherein:

FIG. 1A shows a section through a radially outer segment of a centrifugal drum having an outlet nozzle, wherein the rotational axis runs in the sectional plane; and FIG. 1B shows a section through the portion from FIG. 1A, wherein the rotational axis runs perpendicular to the sectional plane FIG. 2 shows the arrangement from FIGS. 1A and 1B with an assembly tool; and FIG. 3 shows a schematic representation of a centrifugal drum into which the outlet nozzles according to the invention are insertable.

DETAILED DESCRIPTION

FIG. 3 shows a double-conical centrifugal drum configured as a separator drum 100, having a drum wall 110 which is preferably designed for a continuous operation—i.e., the continuous and not batchwise processing of a product.

The separator drum 100 has a vertical rotational axis D. In the conical, or here even double-conically shaped, separator drum 100 is arranged in the drum interior—also termed centrifuging space 20, —a separation disk stack 300 consisting of conical separation disks 400. The separation disks 400 are arranged on a distributor shaft 600. A feed pipe 500 serves to feed a product to be processed into distributor channels 700, and from these into the centrifuging space 200. In the centrifuging space 200, the product is cleared of solids, and optionally, if need be, separated into two or more liquid phases of different density.

One or more outflows 900 for liquid phases serves for the lead-off of the at least one liquid phase, which outflows can be provided, for instance, with skimmer disks.

By contrast, the solids are ejected outward from the centrifugal drum 100 through circumferentially distributed, radially extending openings 800, preferably in the region of the largest radius/circumference of the centrifugal drum.

To this end, an outlet nozzle 1 is respectively inserted, preferably screwed, into the cylindrical openings 800 of the drum wall 110 (FIGS. 1A and 1B). The openings 800 are oriented substantially radially in the drum wall 110.

The outlet nozzle 1 has a nozzle body 2. The nozzle body 2 is substantially cylindrical in shape. In the nozzle body 2 are configured an inlet channel 3 and an outlet channel 4 running at an obtuse angle to the inlet channel 3 at an angle 91°<Alpha<179°. A nozzle block—see the prior art cited in the introduction—is not provided in the nozzle body 2 here, but is optionally conceivable.

Related to the rotational direction U, the outlet channel 4 is directed "backward" in such a way that, in an energy balance, the energy loss of the "centrifugal drum 100" rotating system is, as a result of the product ejection, lower than it would be if the solid is ejected radially from the centrifugal drum 100.

The inlet channel 3 has, toward the inside of the drum an inlet opening 3*a*, a thereto adjoining short conically tapered (funnel-like) portion 3*b*, a thereto adjoining longer cylindrical portion 3*c*, and a rounded channel end 3*d* having a radius R.

The outlet channel 4 has an entry port 4*a* attaching to the channel end 3*d*—here in the radius R of the channel end 3*d*—of the inlet channel 3, a thereto adjoining cylindrical portion 4*b*, and an opening 4*c* which is distanced therefrom by an axial length in the exit direction A.

The inlet channel 3 and the outlet channel 4 here have, over the greatest part of their axial length respectively, a constant diameter. The diameter of the outlet channel 4 is in this case smaller, in particular more than 50% smaller, than the diameter of the inlet channel 3. Moreover, the outlet channel 4 is axially shorter, in particular more than 50% shorter, than the inlet channel 3.

The nozzle body 2 is preferably a component which, except for a torque transmitting contour 5, is rotationally symmetrical. It is thus easy to manufacture. It has radially on the inside a cylindrical portion 2*a* of smaller external diameter and a thereto adjoining cylindrical portion 2*b* of larger external diameter. The torque transmitting contour 5 forms a protrusion 2*c*, which adjoins the cylindrical portion 2*b* in a radially outward direction.

Two or more seals 6*a*, 6*b*—in particular respectively configured as a sealing ring—on the outer circumference of the nozzle body 2 seal the outlet nozzle 1 against the inner circumference of the opening 800 in the drum wall 110. These are positioned on the outlet nozzle in such a way that, when the outlet nozzle is installed, only short and easily cleanable gaps to the outer contour of the drum wall 110 or to the interspace 960 are formed. In particular, this means that the seals 6*a*, 6*b* are preferably fitted at less than 5 mm, or even less than 3 mm distance, before the ends of the cylindrical portions 2*b*, 2*a*.

A thread 7 on the outer circumference of the nozzle body 2 further enables the respective nozzle body 2 to be screwed into the drum wall or into the openings 800 in the drum wall 110, which has a corresponding thread. A bayonet lock or similar closures with rotating opening or closing movement can also be used here.

Preferably, the thread 7 is configured on the outside of the portion 2*b* of larger diameter. The portion 2*b* of larger diameter is screwed into the separator drum 100, or into the drum wall 110 thereof into the opening 800. By contrast, the portions of smaller diameter 2*a* extend into interspaces or openings 960 in inserts 950 in the interior of the separator drum 100, which are shaped such that they conduct a solid phase like a funnel to the outlet nozzles 1.

The torque transmitting contour 5 is configured at one end of the substantially cylindrical nozzle body 2. In the state screwed into the separator drum 100, the contour 5 is accessible from outside and in this way enables the outlet nozzle to be screwed into the opening 800 of the separator drum 100, and the outlet nozzle 1 to be unscrewed from the separator drum 100. In the state screwed fully into the opening 800, it does not however protrude radially outward beyond the outer circumference of the separator drum 100 as seen in FIGS. 1*a* and 1*b*, but is accessible in the outer region of the opening (borehole) 800. For this, and in order to ensure that—related to the rotational direction U—the outlet channel 4 is directed "backward", respectively counter to the rotational direction U in the backward direction on the outside of the drum wall 110, preferably behind each of the openings 800, is respectively configured an oblique notch, in particular a milled recess 115, in the drum wall 110. These notches are designed such that the product, during operation—i.e., while the drum rotates at an operating speed—is ejected obliquely rearward along the notch 115, without at the same time touching the notch in the drum wall 110. For this, the radial depth of the oblique notches counter to the rotational direction U, with increasing distance from the respective opening 800, becomes increasingly small and, before the, in the circumferential direction (backwardly) next, opening 800, becomes equal to zero.

The torque transmitting contour 5 has a non-cylindrical geometry. Here, it is advantageously configured as a rectangular protrusion 2*c*, which at the end is substantially flattened in cross-section and adjoins the cylindrical portion 2*b*. Viewed in cross-section, at the ends chords, as it were, have been recessed out of an imaginary cylinder geometry, the straight base sides or long sides 5*a*, 5*b* of which lie parallel to each other. These base sides form the longer sides of the polygonal contour, or here the rectangular contour, of the protrusion 2*c*. The two further sides are the short sides 5*c* and 5*d* of the rectangular contour of the protrusion 2*c*.

In the transition region from the long sides 5*a*, 5*b* toward the cylindrical portion 2*b*, on the long sides 5*a*, 5*b* are configured rounded surfaces, which widen outward to form the cylindrical portion 2*b*. Preferably, it is provided that the protrusion, starting from the polygonal, in particular rectangular cross-section, merges into the cylindrical portion of the nozzle body via rounded surfaces having a radius R1 larger than 1.0 mm, in particular more than 2 mm.

The radii R1 are here advantageously dimensioned such that they are as large as the maximum distance of the parallel base sides 5*a*, 5*b* of the torque transmitting contour 5 from the outer circumference of the cylindrical portion 2*b*, which has a larger cross section than the protrusion 2*c*.

Starting from one end of the cylindrical portion 2*b* of the nozzle body 2, it is thus preferred that a transition region to the torque transmission portion 5, having large or outward opening radii R1, is provided. For radii R1 of this type are significantly less prone to dirt accumulations or incrustations than undercuts or the like. In this respect, a torque transmitting contour 5 that is only barely prone or not prone to dirt accumulations or incrustations and which can be cleaned in a thoroughly hygienic manner is provided.

One of the short sides—the short side 5*d*—of the torque transmitting contour 5 is configured as an oblique surface. The oblique surface is configured on the short side 5*d*, which during operation, upon rotation of the separator drum 100, is directed rearward counter to the rotational direction U. The opening 4*c* of the exit channel 4 lies in the region of this oblique surface. Preferably, it lies in the radial outer half of the oblique surface or of the short side 5*d*. The oblique surface 5*d* is further preferably oriented perpendicular to the axial direction of the exit channel 3.

An assembly tool 10 is used for the installation and removal of the outlet nozzle 1 (see FIG. 2). The assembly tool 10 is of two-piece design. It has a rotatable socket wrench 11 and a sleeve 12, which can be placed over the socket wrench 11.

The socket wrench 11 of the assembly tool 10 has a torque transmitting contour 13, which is complementary to the torque transmitting contour 5 of the outlet nozzle 1 and which is here configured as a slot. The socket wrench is in the region of the slot mountable onto the torque transmitting contour 5. The slot is shaped such that it is mountable in a positive-locking manner in such a way onto the complementary torque transmitting contour 5 of the outlet nozzle that a screwing and unscrewing of the outlet nozzle 5 into the outlet opening 800 and out of the outlet opening 800 can be achieved. The mounting jaw 13 adjoins a type of rod or shaft 14, on whose end facing away from the torque transmitting contour 13 is in turn provided a handle or a protrusion for a further tool (not represented here) in order to be able to rotate the socket wrench 11.

In order to facilitate the installation and removal of the outlet nozzle 1 (for instance in a rather poorly accessible hood surrounding the centrifugal drum 100), the sleeve 12 is slid over socket wrench 11, the internal diameter of the sleeve 12 is dimensioned such that the outlet nozzle 1 can be captively clamped to the sealing ring 6*b* in the end of the pipe. In this way, the sleeve 12 can be guided with the clamped outlet nozzle 1, for installation purposes, to shortly before the opening 800 of the drum wall 110. After this, with the socket wrench, the nozzle body 2 is screwed into the outlet opening 800. The sleeve 12 and the outlet opening 800 can have complementary conical lead-in portions, which are shaped such that they allow the end of the sleeve 12 to be able to engage in the end of the outlet opening 800.

For the release of the outlet nozzle 1, the end of the sleeve 12 is inserted into the radially outer end of the outlet opening 800 (preferably provided at the end with a short funnel geometry facilitating the introduction of the sleeve 12) in the drum wall 110 and is held there with a predefined force. Next, with the socket wrench 11, the outlet nozzle 1 is screwed loose to the point where, during the unscrewing, the sealing ring 6*b* of the outlet nozzle 1 slides into the sleeve 12, since the sleeve 12 is pressed with a predefined force into the opening 800 (or onto the opening 800). The outlet nozzle 1 can now be totally unscrewed from the outlet opening and finally, in the tube 12, removed or extracted from the space surrounding the centrifugal drum 100.

In this way, the installation and the removal of the outlet nozzle 1 into the centrifugal drum 100 are possible in a structurally simple manner.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

REFERENCE SYMBOLS outlet nozzle 1
nozzle body 2
portions 2*a*, 2*b*
protrusion 2*c*
inlet channel 3
inlet opening 3*a*
tapered portion 3*b*
cylindrical portion 3*c*
channel end 3*d*
outlet channel 4
entry port 4*a*
cylindrical portion 4*b*
exit opening 4*c*
torque transmitting contour 5
base sides 5*a*, 5*b*
short sides 5*c*, 5*d*
seals 6
thread 7
assembly tool 10
socket wrench 11
sleeve 12
torque transmitting contour 13
shaft 14
separator drum 100
drum wall 110
milled recess 115
centrifuging space 200
separation disk stack 300
separation disk 400
feed pipe 500
distributor shaft 600
distributor channels 700
exit openings 800
outflows 900
inserts 950
interspaces 960 radii R, R1
angle Alpha
exit direction A
rotational axis D
rotational direction U

What is claimed is:

1. An outlet nozzle for centrifugal drums, the outlet nozzle comprising:

a nozzle body having a cylindrical portion and a protrusion adjoining the nozzle body, wherein an inlet channel and an outlet channel are arranged in the nozzle body, wherein the outlet channel is oriented at an angle to the inlet channel, and wherein the protrusion is a torque transmitting contour configured for application of a tool having a complementarily configured tool/torque transmitting contour, in order to rotatingly fasten the nozzle body in an opening of a rotatable centrifugal drum and to release the nozzle body from the opening, wherein a cross-section of the protrusion in a direction perpendicular to the inlet channel is polygonal and is smaller than a cross-section of the cylindrical portion, and wherein the protrusion, starting from the polygonal cross-section, merges into the cylindrical portion of the nozzle body via rounded surfaces, which widen outward towards a circumference of the cylindrical portion, having a radius larger than 1.0 mm.

2. The outlet nozzle of claim 1, wherein the protrusion, starting from the polygonal cross-section, merges into the cylindrical portion of the nozzle body via the rounded surfaces having a radius larger than 2.0 mm.

3. The outlet nozzle of claim 1, wherein the inlet channel and the outlet channel are oriented at an obtuse angle to each other.

4. The outlet nozzle of claim 1, wherein an exit end of the outlet channel is configured in a region of the protrusion.

5. The outlet nozzle of claim 4, wherein the exit end of the outlet channel is configured in a radial outer half of the protrusion.

6. The outlet nozzle of claim 1, further comprising: the nozzle body having two or more seals configured to seal against an inner circumference of the opening in a drum wall of the rotatable centrifugal drum.

7. The outlet nozzle of claim 6, wherein the two or more seals are positioned in such a way on the outlet nozzle that, when the outlet nozzle is installed, only short cleanable gaps to an outer contour of the drum wall or to an interspace are formed.

8. A centrifugal drum, comprising: a drum wall with a plurality of circumferentially distributed openings; and a plurality of outlet nozzles respectively arranged in one of the plurality of circumferentially distributed openings, wherein each of the plurality of outlet nozzles comprises a nozzle body having a cylindrical portion and a protrusion adjoining the nozzle body, wherein an inlet channel and an outlet channel are arranged in the nozzle body, wherein the outlet channel is oriented at an angle to the inlet channel, and wherein the protrusion is a torque transmitting contour configured for application of a tool having a complementarily configured tool/torque transmitting contour, in order to rotatingly fasten the nozzle body in the respective one of the plurality of circumferentially distributed openings and to release the nozzle body from the respective one of the plurality of circumferentially distributed openings, wherein the protrusion has a polygonal cross-section, which is smaller than a cross-section of the cylindrical portion, and wherein the protrusion, starting from the polygonal cross-section, merges into the cylindrical portion of the nozzle body via rounded surfaces having a radius larger than 1.0 mm, wherein each of the plurality of outlet nozzles, when fully screwed into one of the plurality of circumferentially distributed openings, do not protrude radially outward beyond an outer circumference of the centrifugal drum.

9. The centrifugal drum of claim 8, wherein a notch is configured in the drum wall respectively counter to a rotational direction in a backward direction on an outside of the drum wall, behind each of the one of the plurality of circumferentially distributed openings.

* * * * *